United States Patent [19]

Wolski

[11] 4,099,161

[45] Jul. 4, 1978

[54] CODE OPERATED DEVICE

[75] Inventor: Raymond A. Wolski, New Britain, Conn.

[73] Assignee: Raymond Engineering Inc., Middletown, Conn.

[21] Appl. No.: 783,869

[22] Filed: Apr. 1, 1977

[51] Int. Cl.[2] ..... H04Q 3/00

[52] U.S. Cl. ..... 340/147 R; 340/167 R; 340/149 R; 340/164 R; 340/543

[58] Field of Search ..... 340/147 R, 274 C, 149 R, 340/164 R, 167 R

[56] References Cited

U.S. PATENT DOCUMENTS 3,500,326 3/1970 Benford ..... 340/164 R

*Primary Examiner*—Harold I. Pitts

[57] ABSTRACT

A coded safing device is provided which produces a desired output upon receipt of a predetermined dual channel binary code. A stepping drive solenoid provides motion input to dual channel electromechanical binary code sensors to drive the sensors and establish the system output only when the proper code has been delivered to permit the electromechanical sensors to move.

26 Claims, 10 Drawing Figures

CODE OPERATED DEVICE

BACKGROUND OF THE INVENTION

Various kinds of SAFE AND ARM devices for various kinds of missiles and other weapons are well known. Some of these devices are concerned with detection of forces acting on the weapon to go to the ARMED state. Other devices involve the use of codes to prevent arming of a weapon unless a predetermined code has been satisfied. Coded SAFE and ARMING devices are particularly important for use with nuclear weapons, although their utility is by no means limited to such weapons. Coded SAFE and ARMING devices have, in recent years, tended to become extremely complicated and have relied heavily on electronics technology for coding. However, many of such systems are quite complex, are subject to failure, and can possibly be actuated inadvertently by stray electromagnetic signals or by deliberate unauthorized attempts to actuate the devices.

A well recognized need exists for a reliable electromechanical coded system which will permit a change from a SAFE state to an ARMED state in the event a predetermined code is received in appropriate sequence and will lock to DUD the unit in the event the code is not received in the proper sequence.

SUMMARY OF THE PRESENT INVENTION

In accordance with the present invention, a drive mechanism operates through coded sensors to provide an output signal upon receipt of a predetermined unique coded input signal. In its preferred configuration, the device of the present invention consists of a synchronously driven stepping drive solenoid and dual channel electromechanical binary code sensors. The device provides a mechanical output signal to change from a SAFE to an ARMED state when the received input code signals match a stored dual channel mechanical code. If an improper input signal is received, the device will mechanically lock to prevent any further advancement toward the ARMED state and thus DUD the unit.

The dual channel mechanical code is stored on rotating wheels which have tooth elements on the periphery to form contoured or cammed code wheels. Locking probes are positioned relative to the code wheels by coded signals. If the proper code signals are received, the locking probes are positioned to be out of the path of the advancing teeth as the code wheels rotate. However, a probe will come into locking engagement with a code wheel in the event an improper code signal is received. A manual or automatic reset feature may be incorporated to reset the device to the SAFE position in preparation for receipt of another sequence of coded input signals in the event a lockout does occur. This resetting is accomplished by rotating the mechanical code wheels from whatever intermediate position they may have attained back to the SAFE position.

There are preferably two code channels. Each code channel has two code wheels, and the code wheels within each channel carry complementary code patterns.

Although a variety of input signals may be employed, the preferred embodiment of the present invention operates on coded optical input signals. When the optical input signals are coded in conformity with the stored mechanical code of the code wheels, the device will be actuated from the SAFE position to the ARMED position to produce an output signal for arming a device. An improper input code will DUD the device.

Although the device of the present invention will be described in connection with a SAFE and ARM device for weapons, it should be pointed out that its use is not limited to that application. In its broadest sense, the device of the present invention may be considered to be a coded locking device, and it may be used for any application in which it is desired to generate an output signal such as a mechanical movement, in response to the receipt of an appropriate input code.

Accordingly, one object of the present invention is to provide a novel and improved coded locking device.

Still another object of the present invention is to provide a novel and improved coded SAFE and ARM device for weapons use.

Still another object of the present invention is to provide a novel and improved coded safing device employing electromechanical binary code sensors.

Still another object of the present invention is to provide a novel and improved coded safing device which will generate an output signal when an input signal matches a stored mechanical code.

Still another object of the present invention is to provide a novel and improved coded safing device in which the device will be mechanically locked in a DUD condition in the event the received input code does not correspond with a stored mechanical code.

Other objects and advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
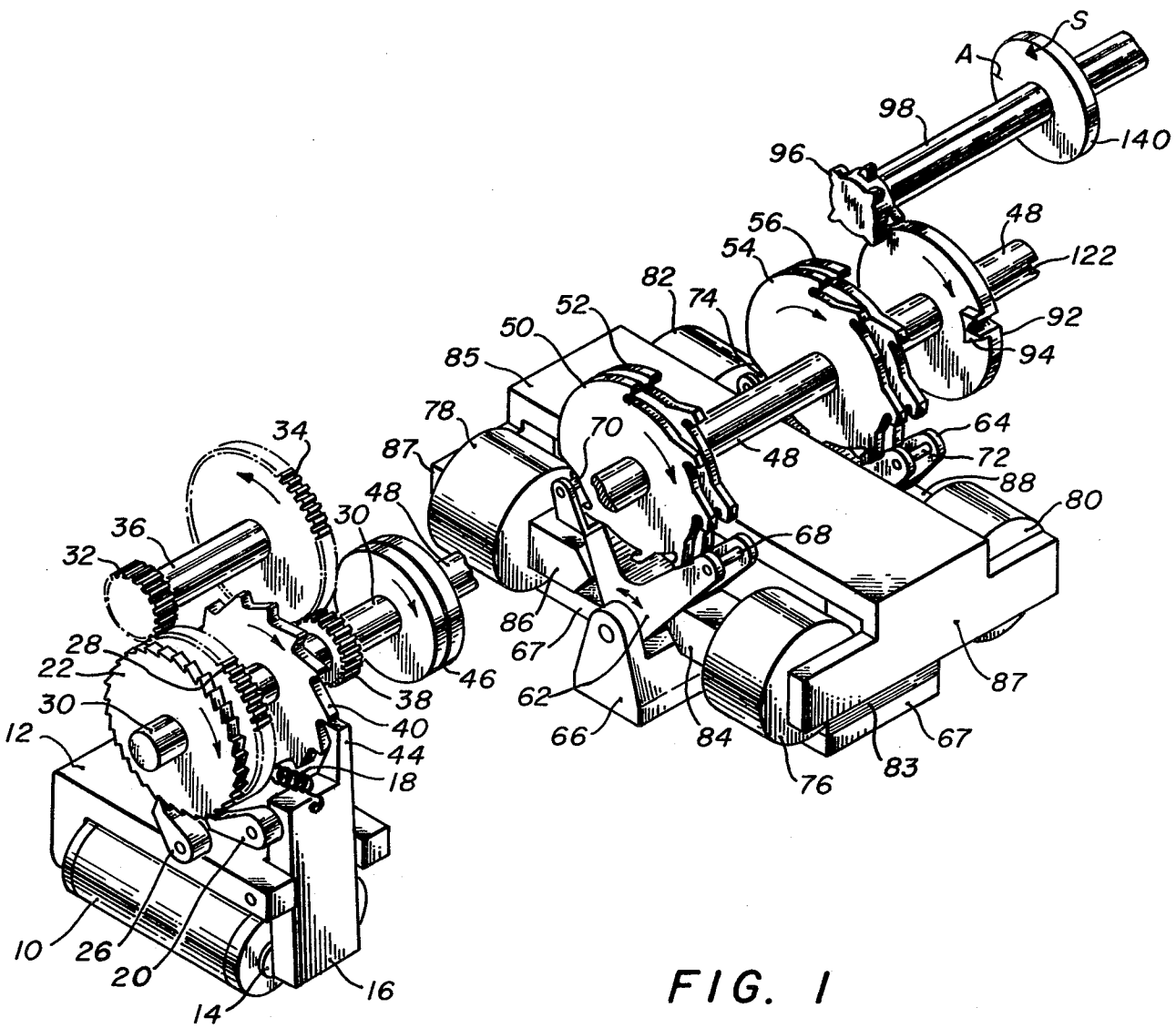
FIG. 1 is a perspective schematic representation of the coded safing device of the present invention.

Referring to FIG. 1, a perspective and somewhat pictorial representation of the device of the present invention is shown. Although not all supporting framework is shown, it will be understood that the device is enclosed in a housing and is, preferably, environmentally sealed.

A prime mover in the form of a stepping solenoid 10 receives pulsed operating signals, those pulses operating signals being synchronized with coded signals delivered to another part of the device as will be more fully discussed hereinafter. Stepping solenoid 10 is mounted on a support 12 which would be fixed to the housing. When solenoid 10 is activated, the lower end of a clapper 16 which is pivotally mounted on support 12 is magnetically pulled toward the solenoid. A spring 18 is grounded at one end on support 12 (the ground connection not being shown because of the overlap of parts) and the other end of spring 18 is connected to the top end of clapper 16 to bias clapper 16 in the counterclockwise direction. Thus, when stepping solenoid 10 is deactivated, clapper 16 is rotated in a counterclockwise direction to the position shown in FIG. 1. When pulsed operating signals are delivered to solenoid 10, each pulse causes clapper 16 to rotate in a clockwise direction. Upon termination of the pulsed operating signal, spring 18 causes clapper 16 to again pivot in the counterclockwise direction to return to the position shown in FIG. 1.

An advancing pawl 20 is pivotally mounted on clapper 16, pawl 20 being spring biased in a clockwise direction against a ratchet wheel 22. When stepping solenoid 10 is actuated by an input pulse, the clockwise rotation of clapper 16 will carry advancing pawl 20 with the clapper to disengage pawl 20 from one of the teeth on ratchet wheel 22 (advancing pawl 20 pivoting slightly counterclockwise during that movement), and advancing pawl 20 will then be urged into position against ratchet wheel 22 to engage the next tooth in the counterclockwise direction. Discontinuance of the stepping pulse to solenoid 10 then results in counterclockwise pivoting of clapper 16, and advancing pawl 20 engages that next counterclockwise tooth to drive ratchet wheel 22 one step in a clockwise direction. In a preferred embodiment of the invention, that one clockwise step is equal to 2.5° of rotation. A back stop pawl 26 is pivotally mounted on support 12 and is spring biased against ratchet wheel 22 to prevent counterclockwise rotation of ratchet wheel 22 during the cycling of the clapper to accomplish the advancing step.

Ratchet wheel 22 and a gear 28 are fastened together and are rotatably mounted on a common shaft 30 so that they are free to rotate relative to shaft 30. The clockwise advancing step of ratchet wheel 22 and gear 28 causes gear 28 to drive through gears 32 and 34 on a shaft 36 to a final output gear 38 which is mounted on and fixed to shaft 30. The overall ratio of the gear train made up of gears 28, 32, 34 and 38 is 8:1 in a preferred embodiment, so that the rotation of gear 38 for a single cycling of solenoid 10 and clapper 16 is 20°. Output gear 38 and an output limiter cam 40 are both fastened on common shaft 30. Cam 40 is in the form of a disc having 18 tooth-like lobes spaced 20° apart around the periphery of the disc. A back stop pawl 44 extending from clapper 16 cooperates with the teeth on cam 40 to restrict the rotation of shaft 42 to discrete 20° clockwise rotational movements as the result of each cycling of stepping solenoid 10. As can be seen, clockwise movement of clapper 16 moves pawl 44 out of the path of the teeth on cam 40, and counterclockwise return of clapper 16 returns pawl 44 to the position to engage the next advancing tooth on cam 40.

Shaft 30 is connected to one plate of a reset clutch 46, and the other plate of the reset clutch is connected to a shaft 48 (part of which is broken away to assist in clarity of illustration). Clutch 46 is a positive ball detent clutch with detenting holes spaced 20° apart on each plate. Clockwise rotation of shaft 30 is positively transmitted through reset clutch 46 to drive shaft 48 in a clockwise direction, so that shaft 48 also rotates in discrete 20° clockwise steps for each cycling of stepping solenoid 10.

Figure 4:
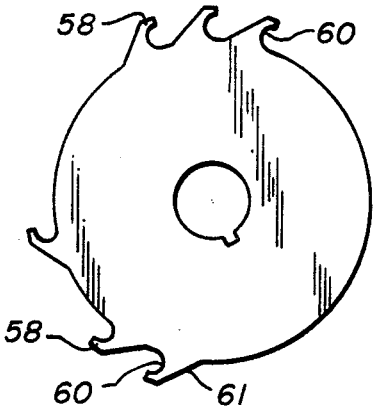
FIG. 4 is a showing of a representative code wheel and locking probe used in the embodiment of FIG. 1.
Figures 6A, 6B:
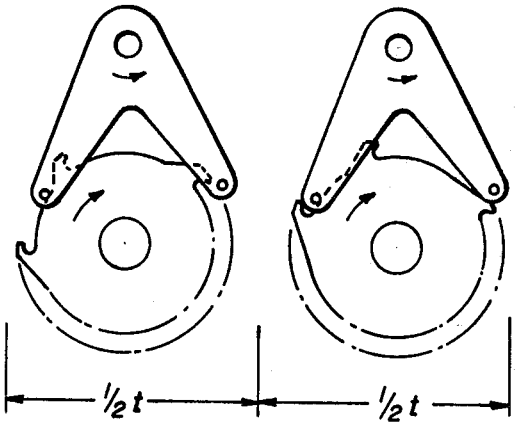
FIGS. 6*a* and 6*b* show representative code wheel operations.

Two channels of code wheels are mounted on shaft 48. One channel of code wheels includes a pair of spaced apart coded discs 50 and 52, and the other channel of code wheels similarly consists of a pair of spaced apart coded discs 54 and 56. Within each code channel, the two discs will carry complementary codes. Thus, the codes on discs 50 and 52 will be the complement of each other; and the codes on discs 54 and 56 will be the complement of each other. The code discs 50, 52, 54 and 56 may be viewed as peripheral coded drum wheels. Referring to FIG. 4, a typical coded drum wheel is shown which may be considered representative of each of the code wheels (but each wheel will, of course, have a different code). The wheel or disc has a series of peripheral teeth 58 with a locking recess 60 between each tooth and the body of the wheel. Those locking recesses 60 serve to interact with locking probes to prevent rotation of the code wheels and shaft 48 in the event the proper actuating code is not delivered to each code wheel.

Pallet assemblies 62 and 64 are operatively associated with each of the dual channeled code wheels, pallet assembly 62 cooperating with discs 50 and 52 and pallet assembly 64 cooperating with discs 54 and 56. Pallet assemblies 62 and 64 are pivotally mounted on supports 66 (only one of which can be seen in FIG. 1), and they are free to oscillate about their connections to supports 66. The supports extend outwardly from the center of a support plate 67, and plate 67 and supports 66 form part of a magnetic circuit for actuating the pallets. Pallet assembly 62 has a locking pin 68 which is positioned in alignment with the teeth on disc 52. Locking pin 68 is positioned between spaced apart ends of the pallet assembly which are proportioned to straddle wheel 52 and let wheel 52 pass when the pallet is rotated clockwise. A second locking pin 70 on pallet 62 is axially displaced or offset (relative to the axis of shaft 48) so that locking pin 70 is aligned with the teeth on disc 50, locking pin 70 being positioned between spaced apart ends on pallet 62 which straddle wheel 50 to permit wheel 50 to pass when the pallet is rotated counterclockwise. Similarly, pallet 64 has a first locking pin 72 positioned to interact with the teeth on disc 56, locking pin 72 being positioned between spaced apart ends of the pallet which straddle disc 56 to permit wheel 56 to pass when the pallet is rotated clockwise; and pallet 64 also has a second locking pin 74 which is positioned to interact with the teeth on disc 54, locking pin 74 being displaced axially with respect to pin 72 and being contained between spaced apart ends of the pallet which straddle disc 54 to permit wheel 54 to pass when the pallet is rotated counterclockwise. Locking pins 68, 70, 72 and 74 constitute locking probes for the code wheels.

Since the code wheels are fixed on shaft 48, the code wheels will rotate with shaft 48 as long as there is no interfering engagement between any lock pin and a tooth on the code wheel with which it is associated. However, if a locking pin is positioned to interfere with rotational movement of a tooth, the locking pin will seat in the locking recess between the tooth and the wheel, and no further rotational movement of any of the code wheels or shaft 48 will be permitted, thus locking the device until it is reset.

The pallets 62 and 64 are rocked about their pivot connections on support 66 by the action of four code or discriminator solenoids 76, 78, 80 and 82 and their respective cores 84, 86, 88 and 90 (90 not being visible). Solenoids 76 through 82 are actuated by coded pulses which will polarize the cores to rock the pallet assemblies on their pivot supports and latch the pallets in either the clockwise or counterclockwise positions.

The electromagnetic circuit for rocking the pallet assemblies includes a permanent magnet 83. Plate 67 abuts the south pole of permanent magnet 83, so plate 67, pallet supports 66, and both pallet assemblies 62 and 64 are polarized south. Another plate 85 abuts the north pole of permanent magnet 83, and plate 85 has side wings 87 to which the cores 84, 86, 88 and 90 of the solenoids are attached, so that the cores are normally polarized north. Depending on the direction of current through the coils of the solenoids the cores will be polarized north or south. Solenoids 76 and 78 are connected in parallel and opposed (see FIG. 2) so current in one direction will cause core 84 to become more north and core 86 to become more south, whereby pallet assembly 62 will pivot clockwise as shown. Conversely, current to solenoids 76 and 78 in the other direction will cause core 84 to become more south and core 86 to become more north, whereby pallet assembly 62 will pivot counterclockwise. Solenoids 80 and 82 are similarly connected in parallel and opposed (see FIG. 2) to pivot pallet assembly 64 in the same manner.

The pallet assemblies are moved in accordance with coded signals to the solenoids. If the coded signals are in appropriate sequence, the pallet assemblies will be rocked so that the locking pins will be in a position of potential interference with the teeth on the respective discs but will always be moved out of the position of potential engagement before the disc rotates to the position where the locking pin would engage a locking recess. In proper operation, for each pair of code wheels in a channel, one of the locking pins will always be moved inward with respect to its aligned code wheel to be in a position of potential engagement with a tooth and its associated lock recess for the next rotational movement of shaft 48, and the other locking pin will be moved outwardly with respect to the other code wheel to be out of the path of the other wheel. Actuation of the solenoids by the appropriate code in synchronism with the next incremental movement of shaft 48 will move the potentially interfering locking pin out of the advancing path of the tooth and permit 20° rotational movement of shaft 48. However, if the appropriate codes are not delivered to the system to actuate the code solenoids, the potentially interfering locking pin will not be moved out of the advancing path of the next tooth on the wheel, and the locking pin will move into locking engagement with the lock recess 60 between the tooth and its disc. This locking engagement will be permanent in the sense that there is interference engagement between the tooth and the locking pin so that the pallet can no longer be rocked on its pivot connection to free the locking pin from the lock recess. Thus, no further advancement of the device from the SAFE state to the ARMED state would be permitted once an improper code has been received.

Referring to FIGS. *3a*, *3b* and *3c*, an illustration of the foregoing is shown. FIG. *3a* shows a typical digital code for association with the cam pattern of FIG. *3b*. The digital code for association with the cam pattern of FIG. *3c* would be the complement of the pattern of FIG. *3a*. FIGS. *3b* and *3c* show code wheel tooth or cam patterns A and B laid out in a straight line rather than on the wheel, and rotation of the wheel is represented by straight line movement of the patterns shown in FIGS. *3b* and *3c*. A "1" state of the code is consistent with one of an associated pair of lock pins being moved into the path of the teeth for potential interfering engagement with a lock recess 60; the other lock pin of an associated pair will, of course, be moved outward from the code wheel so that it is out of the path for potential interfering engagement with the tooth. The lock pin moved inwardly in the "1" state is shown in FIG. *3b*, while the lock pin moved outwardly in the "0" state is shown in FIG. *3c*. As the code wheels are indexed leftward in 20° increments relative to the lock pins, the lock pin of FIG. *3b* will come into interfering engagement with lock recess 60 of the first tooth of tooth pattern A unless the lock pin is moved outwardly to the position shown in phantom at the appropriate time. The lock pin of FIG. *3c* being positioned outwardly beyond the teeth permits movement of the tooth pattern B without interference with the first tooth of pattern B. The code in FIG. *3a* shows a "0" state for the lock pin of FIG. *3b* as the first tooth approaches the lock pin. Thus, the lock pin of FIG. *3b* will move outwardly to be out of potential interfering engagement with the first tooth and its lock recess. Similarly, the lock pin of FIG. *3c* will, in accordance with the "1" state of the inverted code, move inwardly as shown in the phantom position to be in the position of potential locking engagement with the next tooth. As will be seen from further study of the code of FIG. *3a* and the cam patterns A and B of FIGS. *3b* and *3c*, each of the code wheels depicted in FIGS. *3b* and *3c* will be permitted to move without interfering engagement with the associated lock pins as long as the code and its complement are delivered in appropriate timing to actuate the lock pins associated with each cam pattern. If, however, the appropriate signal is not delivered to actuate each lock pin at the appropriate time, one of the lock pins will come into interfering and locking engagement with the lock recess of a tooth, and no further movement of the system will be permitted in the direction toward the ARMED state.

Figure 5:
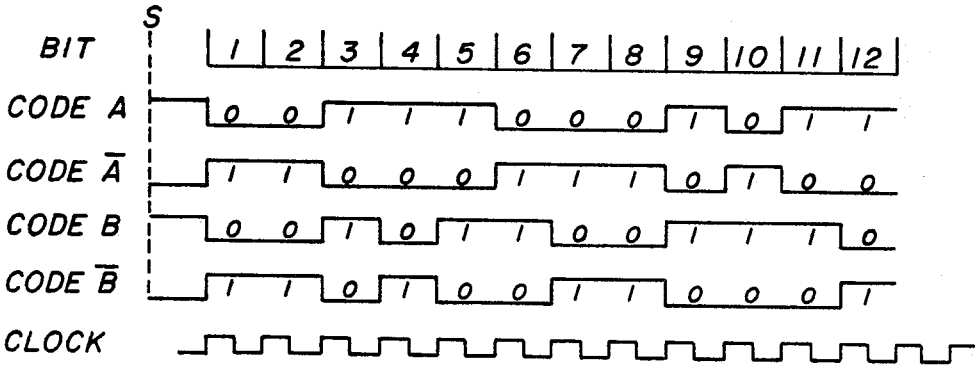
FIG. 5 is a showing of code and clock signals.

The system of the present invention requires a unique code synchronized with a clock signal. In the preferred embodiment the unique code consists of four lines of 12 coded bits of digital "1's" and "0's" synchronized with a clock signal. A representative code is shown in FIG. 5 which would be used to rotate shaft 48 240°. As can be seen in FIG. 5, there are two individual codes, Codes A and B and their complements $\overline{A}$ and $\overline{B}$. Code A and its complement $\overline{A}$ are connected to operate solenoids 76 and 78 and pallet 62 and its code probes; and Code B and its complement $\overline{B}$ are connected to operate solenoids 80 and 82 and pallet 64 and its code probes. The code signals are synchronized with clock pulses of duration equal to each code bit, the clock signals being delivered to stepping solenoid 10 to operate clapper 16.

Referring to FIGS. *6a* and *6b*, a code wheel is shown to illustrate the synchronism between operation of the code wheels and clapper 16. The drawing should be turned 180° to make FIGS. *6a* and *6b* conform to the other figures. The code wheel depicted in FIGS. *6a* and *6b* is merely illustrative for "1" bits; it is not coded to conform to the codes of FIG. 5. When a "1" code bit is received, the pallet is pivoted counterclockwise within the first half of the time duration of the code bit to "set" the code probe. This movement to "set" the code probe is depicted in FIG. *6a*. During this first half of the code bit, the clock pulse is up and is delivered to solenoid driver 10 to rotate clapper 16 clockwise and energize spring 18, but no rotation of the code wheels occurs. During the second half of the duration of the code bit, the clock pulse is down, solenoid driver 10 is deenergized and spring 18 contracts to rotate clapper 16 counterclockwise to drive through the gear train to rotate shaft 48 and the code wheels through a 20° arc. The movement of the code wheel is depicted in FIG. *6b*. When a "0" code bit is received, the same process occurs, except that the pallets are pivoted clockwise. Thus, it can be seen that the code probes, i.e. the lock pins, are first moved to set or sensing positions as the clapper is being cocked, and the code wheels then move while the lock pins remain stationary.

Assuming that the coded actuating signals delivered to the discriminator solenoids correctly match the mechanical codes of the code wheels, shaft 48 will be stepped in a clockwise direction in a series of 20° indexing steps. An index wheel 92 mounted on shaft 48 has a cam projection and notch assembly 94 for engagement with a geneva star wheel 96. After twelve coding steps of 20° rotation each of index wheel 92, one or more further steps of shaft 48 (from the clock pulses delivered to solenoid driver 10) will result in one actuating sequence of geneva star wheel 96 to rotate the star wheel 90°. Star wheel 96 is attached to an output shaft 98 which, of course, undergoes one 90° rotation step for the final 20° rotation of shaft 48 and index wheel 92. Shaft 98 is connected to the device to be armed, and the single 90° rotation of shaft 98 can be used to perform a single step arming function for the device to be ARMED.

Figure 2:
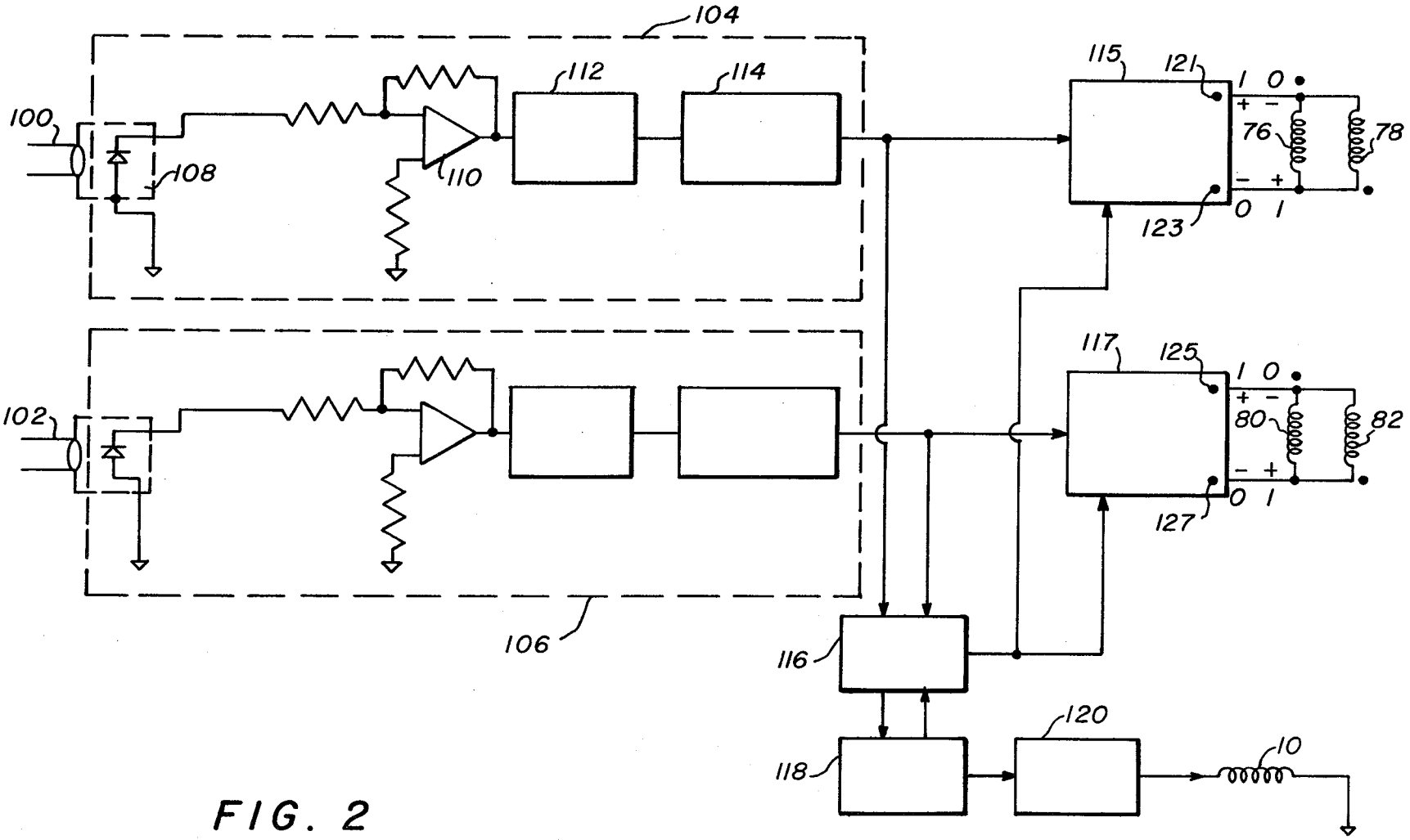
FIG. 2 is a block diagram of the electrical circuit for delivering coded input signals to the device of FIG. 1.
Figure 3A:
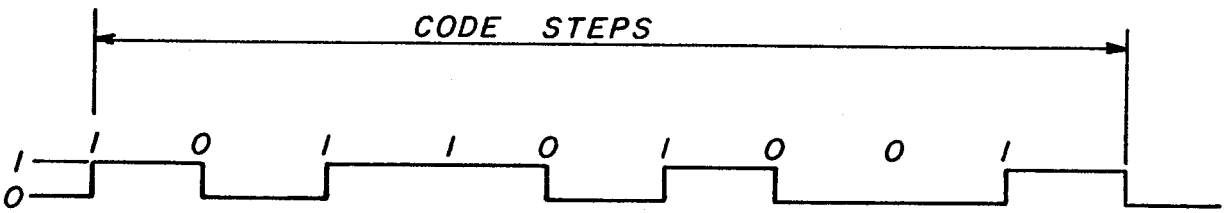
FIG. 3*a* is a representation of a typical input code.
Figure 3B:
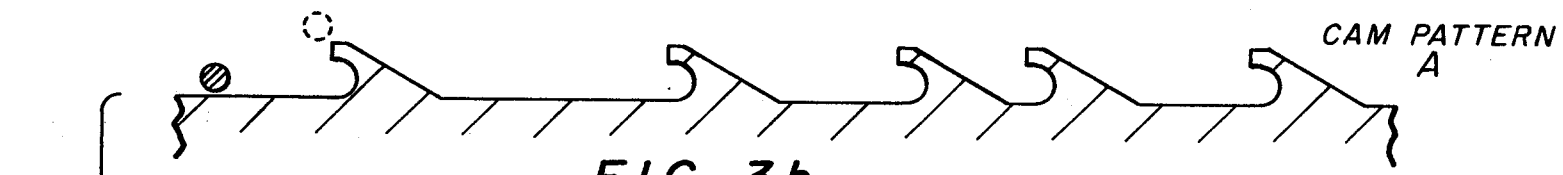
FIGS. 3*b* and 3*c* are representations of the mechanically coded wheels with the outer cammed surfaces thereof laid in a linear pattern.
Figure 3C:
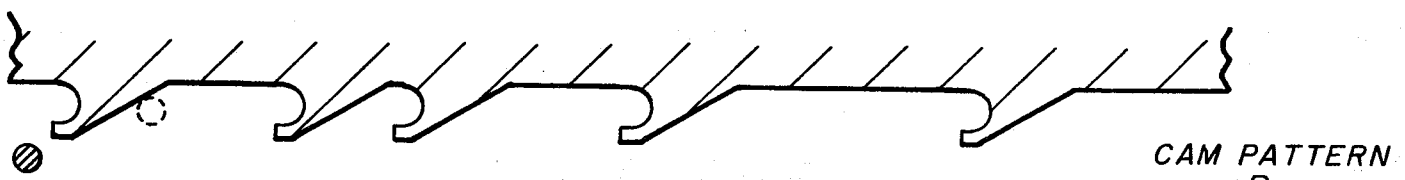

Referring now to FIG. 2, a block diagram of a typical code system electronics is shown. It will be understood that any suitable code system and electronics capable of delivering the necessary sequence of pulses to the code wheel and clapper solenoids may be used; the system of FIG. 2 is illustrative only. As previously indicated, the preferred configuration for the device receives optical coded input signals. Two separate optical codes are delivered to the device, optical code No. 1 being for comparison with one channel of code wheels consisting of code wheels 50 and 52, and optical code No. 2 being for the second channel of code wheels consisting of code wheels 54 and 56. Optical codes 1 and 2 are indicated in FIG. 2. These optical codes are delivered via fiber optic bundles 100 and 102 to signal processing channel 104 and 106. Each signal processing channel includes an optical connector 108 such as a silicon PIN photodiode, an operational amplifier 110, a filter 112 and a detector 114. Light inputs on fiber optic bundles 100 and 102 constitute optical logic "1" states. A light input on one of the optical bundles irradiates the photodiode 108 which is operating in the photo-voltaic mode and supplies input current to operational amplifier 110. Operational amplifier 110 delivers an analog signal to filter 112, and filter 112 operates to remove extraneous signals which may exist outside of the data pass band of the system. The output from filter 112 is then delivered to signal detector 114. Signal detector 114 is a threshold sensitive limiting detector which squares up the incoming analog signals to provide a digital output signal which is the digital representation of the input optical code. Thus, the outputs from each of the signal processors 104 and 106 are digital codes consisting of digital 1's or 0's depending on the optical signals delivered to the respective processing channels. The output from processor 104 corresponds to Code A, and the output from processor 106 corresponds to Code B.

The detector of each signal processor is connected to a sync detector 116, which is, in turn, connected to oscillator and pule generator 118. Upon the simultaneous appearance of synchronizing bits in optical codes 1 and 2, synchronized digital 1's will be delivered from the detector 114 of each signal processor to sync detector 116. Upon the receipt of these synchronized bits, sync detector 116 will deliver a signal to oscillator and pulse generator 118 to activate the oscillator for a fixed time duration to provide a fixed number of clock pulses in synchronism with data codes from each signal processor. The pulses from pulse generator 118 ae delivered to a pulse amplifier 120 and then to stepping solenoid 10 to provide the series of stepping pulses to operate clapper 16 as described above. The optical codes 1 and 2 following the optical sync signals result in digital Codes A and B, respectively, at the outputs of detectors 114 of signal processors 104 and 106. The detector of processor 104 is connected to a solenoid driver 115 whch is, in turn, connected to solenoids 76 and 78, and the detector 114 of processor 106 is connected to a solenoid driver 117 which is, in turn, connected to solenoids 80 and 82. The output of detector 114 of processor 104 constitutes digital Code A, and the output of detector 114 of processor 106 constitutes a digital Code B, each digital code consisting of a series of pulses of digital 1's and 0's.

Drivers 115 and 117 include transistorized switches which are enabled by signals from sync detector 116. Driver 115 has output terminals 121 and 123. The digital state of terminal 121 corresponds to Code A, and the digital state of terminal 123 corresponds to Code $\overline{A}$. Similarly, the digital state of output terminal 125 of driver 117 corresponds to Code B, and the digital state of terminal 127 of driver 117 corresponds to Code $\overline{B}$. The output at terminal 121 of driver 115 will be positive (corresponding to a digital "1") and the output at terminal 123 of driver 115 will be negative (corresponding to a digital "0") when the output from processor 104, and hence digital Code A, is a "1". Current then flows from terminal 121 to terminal 123 (a condition corresponding to Code A being a "1"). The current flows through solenoids 76 and 78 which are connected in parallel and with reverse polarities between terminals 121 and 123. This will cause core 84 to become more north and core 86 to become more south to pivot pallet 62 clockwise. Conversely, when the output of processor 104 is "0", digital Code A is "0", the output at terminal 121 is "0", and the output of terminal 123 is "1". Current then flows from terminal 123 to terminal 121 (a condition corresponding to Code $\overline{A}$ being a "1"). The current flowing in the reverse direction through solenoids 76 and 78 reverses the polarities of cores 84 and 86 and causes pallet 62 to rock counterclockwise. In a similar manner, as will be understood by those skilled in the art, the digital state at terminal 125 corresponds to Code B and the digital state at terminal 127 corresponds to Code $\overline{B}$. Current will flow from terminal 125 to 127 or vice versa depending on the digital output from processor 106 to rock pallet 64 clockwise and counterclockwise depending on the digital states of Codes B and $\overline{B}$.

As previously explained, if the input optical codes 1 and 2 correspond with the mechanical codes on the code wheel of each of the mechanical code channels, the lock pins will be moved in timely fashion so that the device will progress from its initial SAFE position to a final ARMED position. However, if any signal in optical code 1 or optical code 2 does not correspond with the commensurate mechanical code in the code wheels, the code wheel with which the mismatch occurs will come into locking engagement with one of the locking pins of one of the pallets, and further advancement of the device from the SAFE to the ARMED position will be affirmatively prevented, thereby positively bringing the device to a DUD position.

Referring again to FIG. 1, if a DUD condition does occur, the device can be reset so that it will be in a condition to receive the appropriate code at some later time. Resetting can be accomplished merely by manually rotating shaft 48 in the direction reverse to the direction in which it rotates in going from the SAFE to the ARMED position. A reset notch 122 may be provided in the end of shaft 48 to receive an instrument, such as a screwdriver, to rotate shaft 48 counterclockwise. An indicating wheel 140 on shaft 98 may contain SAFE (S) and ARM (A) markings which are visible, the plate of the device being shown by whichever marking is in the vertical position. Reset clutch 46 permits this counterclockwise rotation of shaft 48 since the output plate of reset clutch 46 will rotate counterclockwise with shaft 48 relative to the input plate of reset clutch 46 which is restrained by the driver indexing mechanism. This counterclockwise rotation of shaft 48 will result in counterclockwise rotation of all of the code wheels. Whichever tooth is in locking engagement with a locking pin will be withdrawn from that locking engagement, and the code wheels will rotate in a counterclockwise direction with the outer camming surfaces 61 (see FIG. 4) of the teeth contacting the locking pins to cam the locking pins out of the way so that the pallet assemblies merely rock back and forth as the code wheels are returned to the original SAFE position.

Figure 7:
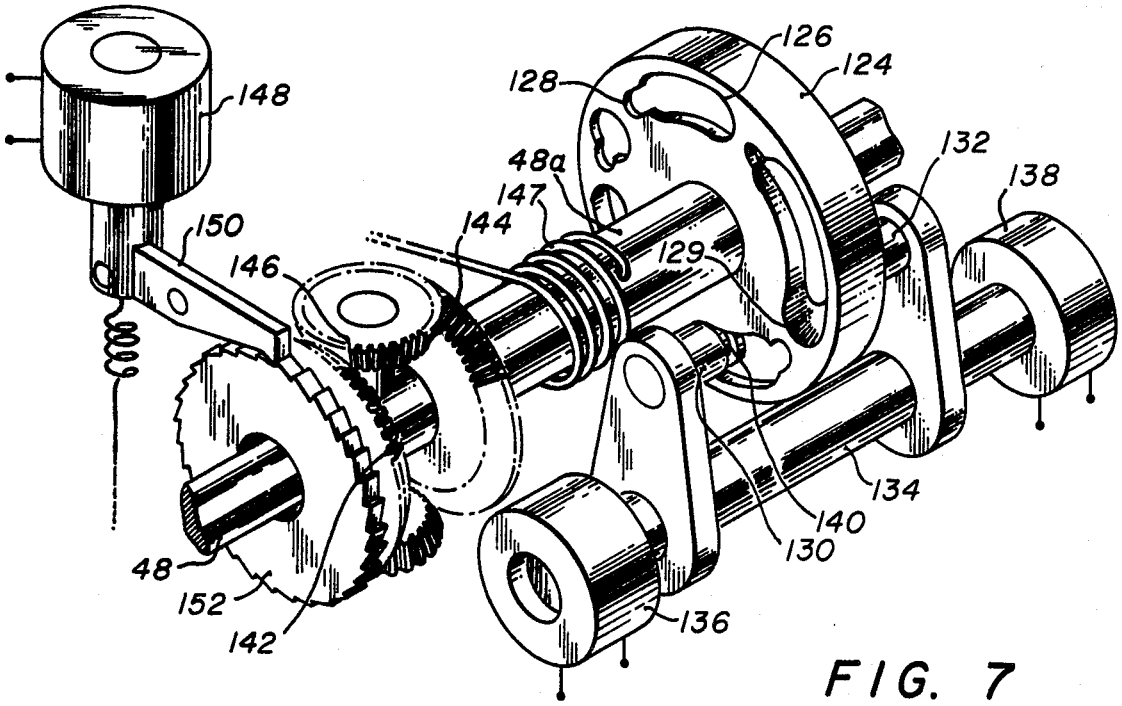
FIG. 7 is a showing of an alternative form of code wheel and locking probe which may be used in place of the code wheels and locking probes of FIG. 1 with an automatic reset mechanism which may be employed in the present invention.

Referring now to FIG. 7, an alternative code wheel 124 is shown. This alternative code wheel has a series of slot or hole patterns 126 on opposite sides of the code wheel. Each slot or hole pattern 126 has an end surface portion 128 of reduced width to form, in effect, a keyhole shape. Locking probes 130 and 132 are mounted on a shaft 134, shaft 134 being translated leftward or rightward by code solenoids 136 and 138. The locking probes are cylindrical elements having reduced portions near the end, the reduced portion 140 of probe 130 being visible in the figure. Code solenoids 136 and 138 function in the same manner as the code solenoids described above. Code wheel 124 is placed between the locking probes, and one of the locking probes penetrates the hole or opening in one face of the wheel at all times. Rotation of wheel 124 is allowed only upon the proper sequencing or pulsing of the solenoids 136 and 138 to withdraw the probe from the opening in the face of the code wheel before the reduced end portion 128 of an opening engages the reduced end portion of a locking probe. Should the solenoids be improperly programmed during indexing of the code wheel, reduced slot 128 on the tail end of the opening will engage the reduced end portion of the locking probe to affirmatively lock the code wheel to the probe so that the probe can not be withdrawn by another code pulse. Thus, the device becomes DUDed as previously described. The end of each hole of slot 126 opposite to the reduced end 128 is sloped as at 129 to serve as a camming surface to cam the probes out of the slots when the code wheels are being reset.

Only one slotted face of code wheel 124 can be seen in FIG. 7. However, it will be understood that each slotted or coded face of wheel 124 constitutes a code wheel corresponding to one of the code wheels of FIG. 1. Therefore, the opposed coded faces of wheel 124 correspond to, e.g., code wheels 50 and 52 of FIG. 1; and the code slots 126 and reduced segments 128 of wheel 124 correspond, respectively, to teeth 58 and locking recesses 60 of the code wheels of FIG. 1.

Instead of the manual reset, an automatic reset may be employed in the form of a differential interposed in shaft 48. This differential is shown in FIG. 7, and it will be understood that it can be incorporated in the embodiment of FIG. 1. Reset clutch 46 is omitted. The differential reset mechanism includes first and second differential gears 142 and 144 rotatably mounted on shat 48 and pinion gears 146 rotatably mounted on an axis fixed to and extending perpendicular from shaft 48. Shaft 48 terminates at gear 144, and is replaced beyond gear 144 with an extension **48*a* integral with gear 144 to the code wheels. The code wheels are fixed on shaft extension 48*a*. A spring 147 is coiled between shaft 48*a* and the casing or ground. A reset solenoid 148 with a locking pawl 150 is positioned for the pawl to engage a ratchet wheel 152 fixed to gear 142. Locking pawl 150 permits clockwise rotation of gear 142 but normally prevents counterclockwise rotation. A DC signal normally powers solenoid 148 to hold pawl 150 in position to engage ratchet wheel 152**.

As the unit is being stepped clockwise from the SAFE to the ARM states, the differential will rotate as a solid unit, and spring 147 would be coiled. Shaft 48 rotates clockwise to drive pinion gears 146 about gear 142 causing gear 144 and shaft **48*a* to rotate clockwise, thus coiling spring 147. If the device locks because of an improper code, the normally present DC signal to solenoid 148 can be removed either automatically or manually, whereby a spring biasing the plunger of the solenoid would pivot pawl 150 out of engagement with ratchet wheel 152 permitting coiled spring 147 to uncoil to rset the unit. The use of an automatically terminated DC signal to actuate the pawl 150** also serves as a safety feature in that the device will be automatically reset in the event of a power failure.

While the preferred embodiment of the present invention has been described having two mechanical code channels, a single code channel could also be employed consistent with all of the other concepts of the present invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A code operated device including:

code means for storing a predetermined code;

lock means forming part of said code means;

locking means associated with said code means;

first actuating means for positioning said locking means relative to said code means in accordance with coded signals delivered to said first actuating means;

second actuating means for positioning said code means in response to actuating signals delivered to said second actuating means in synchronism with coded signals delivered to said first actuating means;

said locking means being positioned out of locking interference with said lock means upon delivery of a predetermined proper sequence of coded signals to said second actuating means, and said locking means coming into locking engagement with said lock means upon delivery of an improper coded signal to said second actuating means; and output means coupled to said code means to perform an output function upon completion of receipt by said second actuating means of a predetermined proper sequence of coded signals.

2. A code operated device as in claim 1 wherein:

said code means includes at least one code wheel; and said lock means includes shaped lock elements formed in the code wheel.

3. A code operated device as in claim 2 wherein:

said locking means includes probe means shaped to engage said lock elements.

4. A code operated device as in claim 1 including:

signal means for delivering coded operating signals to said first actuating means to position locking means and for delivering operating signals to said second actuating means to position said code means.

5. A code operated device as in claim 4 wherein said signal generating means includes:

processing means for receiving coded input signals and generating digital output signals;

signal generating means for receiving said digital output signals and delivering operating signals to said first actuating means; and pulse generating means for delivering operating signals to said second actuating means upon the occurrence of a predetermined digital signal.

6. A code operated device as in claim 1 including:

reset means for resetting the code operated device subsequent to the occurrence of locking engagement between said locking means and said lock means.

7. A code operated device as in claim 6 wherein said reset means includes:

means for repositioning said code means to disengage said lock means from said locking means.

8. A code operated device including:

at least a first pair of first and second coded movable elements for storing predetermined codes, the codes on said first and second coded elements being complementary;

lock means forming part of said first and second coded elements, said lock means defining the code on each of said coded elements;

first locking means associated with said first coded elements;

second locking means associated with said second coded element;

first actuating means in a first state positioning said first locking means in a position out of potential locking engagement with said first coded element and positioning said second locking means in a position of potential locking engagement with said second coded element, and said first actuating means in a second state alternately positioning said first locking means in a position of potential locking engagement with said first coded element and positioning said second locking means in a position out of potential locking engagement with said second coded element;

second actuating means for moving said first and second coded elements relative to said first and second locking means;

means for delivering coded signals to said first actuating means to effect the first or second states of said first actuating means in accordance with said coded signals;

means for delivering operating signals to said second actuating means in synchronism with delivery of said coded signals to said first actuating means to move said coded elements, said coded elements being free to move from a first position toward a second position upon receipt of a predetermined proper series of coded signals by said first actuating means, but the lock means of one of said coded elements coming into locking engagement with its associated lock locking means to terminate movement of said coded elements from said first position to said second position in the event the proper code is not received by said first actuating means; and output means coupled to said coded elements to perform an output function upon movement of said coded elements from a first position to a second position upon receipt of a predetermined proper series of coded signals by said first actuating means.

9. A code operated device as in claim 8 wherein:

each of said coded elements is a code wheel; and said lock means in each code wheel are shaped lock elements formed in the code wheel;

the code wheels being mounted in spaced apart relationship on a common shaft for rotational movement with the shaft.

10. A code operated device as in clam 9 wherein:

each of said locking means includes probe means shaped to engage said lock elements in the code wheels.

11. A code operated device as in claim 9 wherein:

said shaped lock elements are teeth formed in the periphery of each code wheel.

12. A code operated device as in claim 11 wherein:

said teeth have lock recesses formed between the teeth and the code wheel.

13. A code operated device as in claim 11 wherein:

said first and second locking means each includes a locking pin disposed perpendicular to the periphery of its associated code wheel.

14. A code operated device as in claim 13 wherein:

said locking pins are mounted on a common pallet assembly, said pallet assembly being pivotally mounted for rocking motion.

15. A code operated device as in claim 13 wherin:

said first actuating means includes discriminator solenoid means for rocking said pallet assembly in response to coded signals delivered to said solenoid means.

16. A code operated device as in claim 8 wherein:

said second actuating means includes means for moving said code elements in discrete steps;

said output means moving in discrete steps and performing its output function only upon completion of a predetermined number of discrete steps of operation of said code elements.

17. A code operated device as in claim 8 including:

signal generating means for delivering coded operating signals to said first actuating means for positioning of said first and second locking means, and for delivering pulsed operating signals to said second actuating means to position said code elements.

18. A code operated device as in claim 17 wherein:

said second actuating means includes means for moving said code elements in discrete steps;

said output means moving in discrete steps and performing its output function only upon completion of a predetermined number of discrete steps of operation of said code elements.

19. A code operated device as in claim 17 wherein said signal generating means includes:

processing means for receiving coded input signals and generating digital output signals;

signal generating means for receiving said digital output signals and delivering operating signals to said first actuating means; and pulse generating means for delivering operating signals to said second actuating means upon the occurrence of a predetermined digital signal.

20. A code operated device as in claim 8 including:

reset means for resetting the code operated device subsequent to the occurrence of locking engagement between said locking means and said lock means.

21. A code operated device as in claim 20 wherein said reset means includes:

means for repositioning said code means to disengage said lock means from said locking means.

22. A code operated device as in claim 21 wherein:

said reset means includes differential means in said second actuating means, and biasing means urging said coded elements toward said first position thereof.

23. A code operated device as in claim 8 wherein:

each of said code elements is a code wheel having arcuate slots formed therein; and said lock means is a portion of reduced width in each of said slots;

said code wheels being mounted in spaced apart relationship for unitary rotational movement.

24. A code operated device as in claim 23 wherein:

each of said locking means includes a probe having an end element sized to fit in the slot in its associated code wheel, each probe also having a segment of reduced size to engage said reduced width portion of the slot.

25. A code operated device as in claim 8 including:

a second pair of third and fourth coded movable elements for storing predetermined codes, the codes of said third and fourth coded elements being complementary and differing from the codes of said first and second coded elements;

all of said coded elements being mounted on a common shaft and being rotatable with said shaft, said shaft being operatively connected to said second actuating means;

third and fourth locking means associated with said third and fourth coded elements, respectively;

third actuating means in a first state positioning said third locking means in a position out of potential locking engagement with said third coded element and positioning said fourth locking means in a position of potential locking engagement with said fourth coded element, and said third actuating means in a second state alternately positioning said third locking means in a position of potential locking engagement with said third coded element and positioning said fourth locking means in a position out of potential locking engagement with said fourth coded element; and means for delivering second coded signals to said third actuating means to effect the first or second states of said third actuating means in accordance with said coded signals.

26. A code operated device as in claim 25 wherein said second actuating means includes:

stepper means for generating discrete steps of rotary motion in response to an actuating signal; and positive clutch means having an input plate connected to receive said discrete rotary steps, and an output plate connected to said common shaft.

* * * * *